US007773901B2

(12) United States Patent
Cho

(10) Patent No.: US 7,773,901 B2
(45) Date of Patent: Aug. 10, 2010

(54) IMAGE FORMING APPARATUS AND CONTROL METHOD THEREOF

(75) Inventor: Myong-hun Cho, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 220 days.

(21) Appl. No.: 11/953,132

(22) Filed: Dec. 10, 2007

(65) Prior Publication Data

US 2008/0145079 A1 Jun. 19, 2008

(30) Foreign Application Priority Data

Dec. 18, 2006 (KR) ..... 10-2006-0129705
Aug. 1, 2007 (KR) ..... 10-2007-0077430

(51) Int. Cl.
*G03G 15/08* (2006.01)
*G03G 15/00* (2006.01)

(52) U.S. Cl. ..... 399/60; 399/49; 399/72

(58) Field of Classification Search ..... 399/49, 399/72, 301, 66, 60
See application file for complete search history.

(56) References Cited

U.S. PATENT DOCUMENTS 7,257,339 B2 * 8/2007 Yokoyama et al. ..... 399/66
7,330,685 B2 * 2/2008 Matayoshi ..... 399/66
7,590,363 B2 * 9/2009 Yokoyama ..... 399/49
2004/0175196 A1 * 9/2004 Yamamoto et al. ..... 399/49
2004/0197111 A1 * 10/2004 Kuroda ..... 399/66
2005/0169677 A1 * 8/2005 Kaneko
2007/0002291 A1 * 1/2007 Yamada
2007/0286620 A1 * 12/2007 Kitamura ..... 399/49

FOREIGN PATENT DOCUMENTS

JP 11316532 A * 11/1999

OTHER PUBLICATIONS

Motohashi, Toshiaki; "Imaging Device"; Nov. 16, 1999; JP11-316532A; English translation done by FLS, Inc.*

* cited by examiner

*Primary Examiner*—Susan S Lee
(74) *Attorney, Agent, or Firm*—Staas & Halsey LLP

(57) ABSTRACT

An image forming apparatus includes a transport unit having a transport belt which transports a printing medium in a transport direction along a transport path, an image forming unit which transfers toner to the printing medium to form an image, a density evaluation unit which is provided on the transport path of the transport belt and evaluates a density of the image formed by the image forming unit, and a controller which controls the image forming unit to form a test image which has a length in a transport direction that is determined by a position deflection of the transport belt, controls a characteristic of the image forming unit based on a density evaluation of the test image, and controls the transport unit to make the transporting speed of the transport belt a predetermined value or less during the density evaluation of the test image by the density evaluation unit.

28 Claims, 5 Drawing Sheets

IMAGE FORMING APPARATUS AND CONTROL METHOD THEREOF

CROSS-REFERENCE TO RELATED APPLICATIONS

This application claims the benefit of Korean Patent Application No. 2006-129705, filed on Dec. 18, 2006 and No. 2007-77430, filed on Aug. 1, 2007 in the Korean Intellectual Property Office, the disclosures of which are incorporated herein by reference.

BACKGROUND OF THE INVENTION

1. Field of the Invention

Aspects of the present invention relate to an image forming apparatus and a control method thereof, and more particularly, to an image forming apparatus which controls an image forming characteristic using a test image and a control method thereof.

2. Description of the Related Art

An image forming apparatus, such as a laser printer, a copier, and a multi-function device, controls an exposure of a photosensitive member to develop toner, and then transfers and fuses the toner on a printing medium to thereby form an image. In general, an image forming apparatus which can form a color image includes an image forming unit having a laser scanning unit (LSU), a plurality of photosensitive members, a plurality of transfer rollers, etc., which are provided in correspondence to a plurality of colors. For example, a plurality of photosensitive members is arranged along a transport path of a printing medium. The printing medium is transferred along the transport path by a transport unit such as a transport belt.

To control an image forming characteristic of an image forming unit, such as a developing condition and a color registration, the image forming apparatus forms an image (hereinafter, referred to as a "test image") to test qualities of the image forming apparatus in order to determine the image forming characteristic.

FIG. 1 illustrates the formation of a test image by a conventional image forming apparatus. A reference numeral 1 denotes a transport belt. A reference numeral 2 denotes a test image formed in correspondence to plural colors (hereinafter, the test image may also be referred to as a "density mark").

A conventional image forming apparatus transfers toner at a predetermined position on the surface of a transport belt 1 according to test data which is provided to control an image formation characteristic. The transferred toner forms a density mark 2. The image forming apparatus forms the density mark 2 while moving the transport belt 1 in the same way that the transport belt 1 is moved during an actual printing operation, except that the density mark 2 is formed on the transport belt 1 instead of a printing medium. In FIG. 1, a reference character "A" denotes a transporting direction of the transport belt 1.

As illustrated in FIG. 1, the image forming apparatus forms four density marks 2 in correspondence to each color of C (Cyan), M (Magenta), Y (Yellow) and K (Black). Each density mark 2 has a substantially rectangular shape.

The image forming apparatus includes a detector 3 which detects the density mark 2. The detector 3 irradiates light at a predetermined driving voltage and detects light reflected from the density mark 2. The image forming apparatus evaluates the density of the density mark 2 using a detection result obtained by the detector 3. The image forming apparatus determines an image forming characteristic, for example, a developing condition or a color registration condition, based on the calculated density of the evaluated density mark 2.

The detector 3 can perform detection of one density mark 2 multiple times in order to obtain a highly reliable detection result. In addition, instead of only using one detector 3 to detect the density of the density mark, a plurality of detectors 3 can be disposed across a transporting direction "A" of the transport belt 2, to thus perform detection sequentially. In this case, a size "W" of the density mark 2 of each color can be determined by using the following equation (1):

$$W(\text{mm})=[\text{Transporting speed of transport belt(mm/s)}]\times[\text{Detection time (sec)}]\times[\text{The number of times of detection}]\times[\text{The number of detectors}] \quad \text{(Equation (1))}.$$

In Equation 1, the transporting speed of the transport belt refers to the speed at which the transport belt 1 moves the density mark past the detector 3, the detection time refers to time taken by the detector 3 to perform a detection operation one time, the number of times of detection refers to the number of times which the detector 3 performs a detection operation to analyze the density mark, and the number of detectors refers to the number of detectors 3 used during the detection operation.

In addition, the conventional image forming apparatus can control an image forming characteristic repeatedly while changing a drive voltage level of the detector 3 to get a more reliable detection result. In this case, as illustrated in FIG. 1, plural density marks 2 need to be formed on the transport belt 1.

As such, when an image formation characteristic is controlled using a test image, an amount of toner consumed to form the test image depends on the characteristic of the image forming apparatus. That is, when the transporting speed of the transport belt 1 is fast, and when a detection mark is to be analyzed in a highly reliable fashion, the detector 3 or plurality of detectors 3 require a large amount of toner to have sufficient time to analyze the passing density mark, thereby causing a problem of toner consumption.

Also, since the toner transferred to the transport belt 1 to form a test image becomes waste toner, an amount of the waste toner becomes large. Even if the toner transferred to the transport belt 1 is recollected using a reverse transferring method, there is a problem in that a reverse transferring time is prolonged.

SUMMARY OF THE INVENTION

Accordingly, an aspect of the present invention provides an image forming apparatus which can minimize consumption of toner to control an image forming characteristic using a test image and a control method thereof.

An image forming apparatus according to an aspect of the present invention includes a transport unit comprising a transport belt which transports a printing medium in a transport direction along a transport path, an image forming unit which transfers toner to the printing medium to form an image, a density evaluation unit which is provided on the transport path of the transport belt and evaluates a density of the image formed by the image forming unit, and a controller which controls the image forming unit to form a test image which has a length in the transport direction that is determined by a position deflection of the transport belt when an edge of the test image passes an edge of the density evaluation unit, controls a characteristic of the image forming unit based on a density evaluation of the test image, and controls the transport unit to make a transporting speed of the transport belt a predetermined value or less during the density evaluation of the test image by the density evaluation unit.

According to an aspect of the invention, the length of the test image in the transport direction is determined by the following equation:

The length of the test image in the transport direction=the position deflection of the transport belt in the transport direction+a size of detected light reflected from the test image+a margin.

According to an aspect of the invention, the controller controls the transport unit to stop the transport belt from moving according to whether the density evaluation unit detects the test image.

According to an aspect of the invention, the test image is formed on the transport belt.

According to an aspect of the invention, the image forming unit includes a plurality of sub-image forming units which are provided in correspondence to a plurality of colors and arranged along the transport direction of the printing medium, and the controller controls the transport unit to sequentially evaluate densities of a plurality of the test images corresponding to the plurality of sub-image forming units.

According to an aspect of the invention, the density evaluation unit includes at least one detector which detects light reflected from the test image.

According to an aspect of the invention, the density evaluation unit performs the density evaluation of the test image while changing a drive voltage level of the detector.

According to an aspect of the invention, the characteristic of the image forming unit is controlled by determining at least one of a condition of development and a color registration.

According to another aspect of the present invention, a method of controlling an image forming apparatus including a transport unit having a transport belt which transports a printing medium in a transport direction along a transport path, a plurality of image forming units which transfer toner to the printing medium to form an image, and a density evaluation unit which is provided on the transport path of the transport belt and evaluates a density of the image formed by the image forming units includes controlling the image forming units to form a test image which has a length in the transport direction that is determined by a position deflection of the transport belt when an edge of the test image passes an edge of the density evaluation unit; controlling the density evaluation unit to perform a density evaluation of the test image; controlling the transport unit to make a transport speed of the transport belt a predetermined value or less during the density evaluation of the test image by the density evaluation unit; and controlling a characteristic of the image forming units based on the density evaluation of the test image.

Additional aspects and/or advantages of the invention will be set forth in part in the description which follows and, in part, will be obvious from the description, or may be learned by practice of the invention.

BRIEF DESCRIPTION OF THE DRAWINGS

The above and/or other aspects of the present invention will become apparent and more readily appreciated from the following description of the embodiments, taken in conjunction with the accompanying drawings in which.

DETAILED DESCRIPTION OF THE EMBODIMENTS

Figure 1:
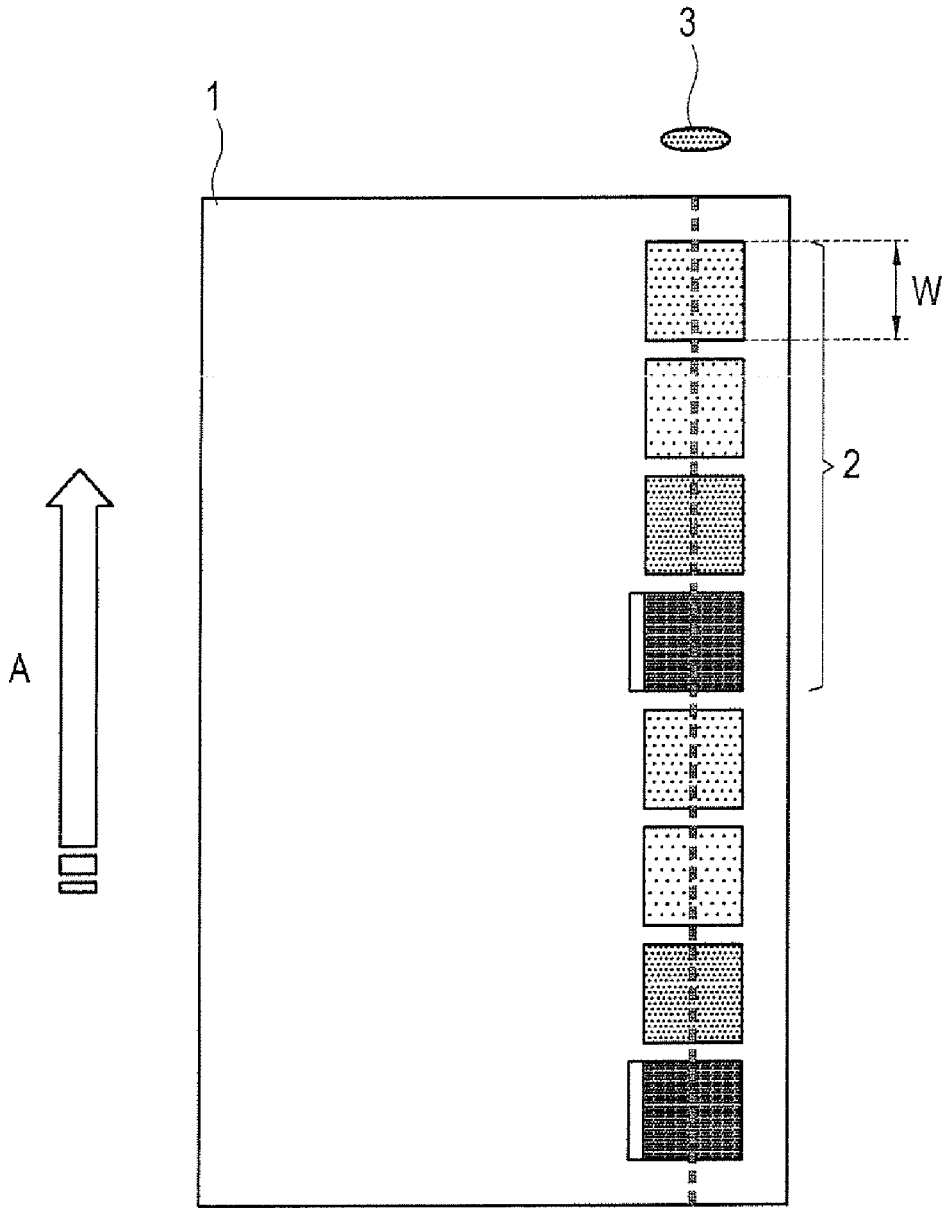
FIG. 1 (RELATED ART)
FIG. 1 is a view illustrating a test image formed by a conventional image forming apparatus.

Reference will now be made in detail to present embodiments of the present invention, examples of which are illustrated in the accompanying drawings, wherein like reference numerals refer to like elements throughout. The embodiments are described below in order to explain the present invention by referring to the figures.

Figure 2:
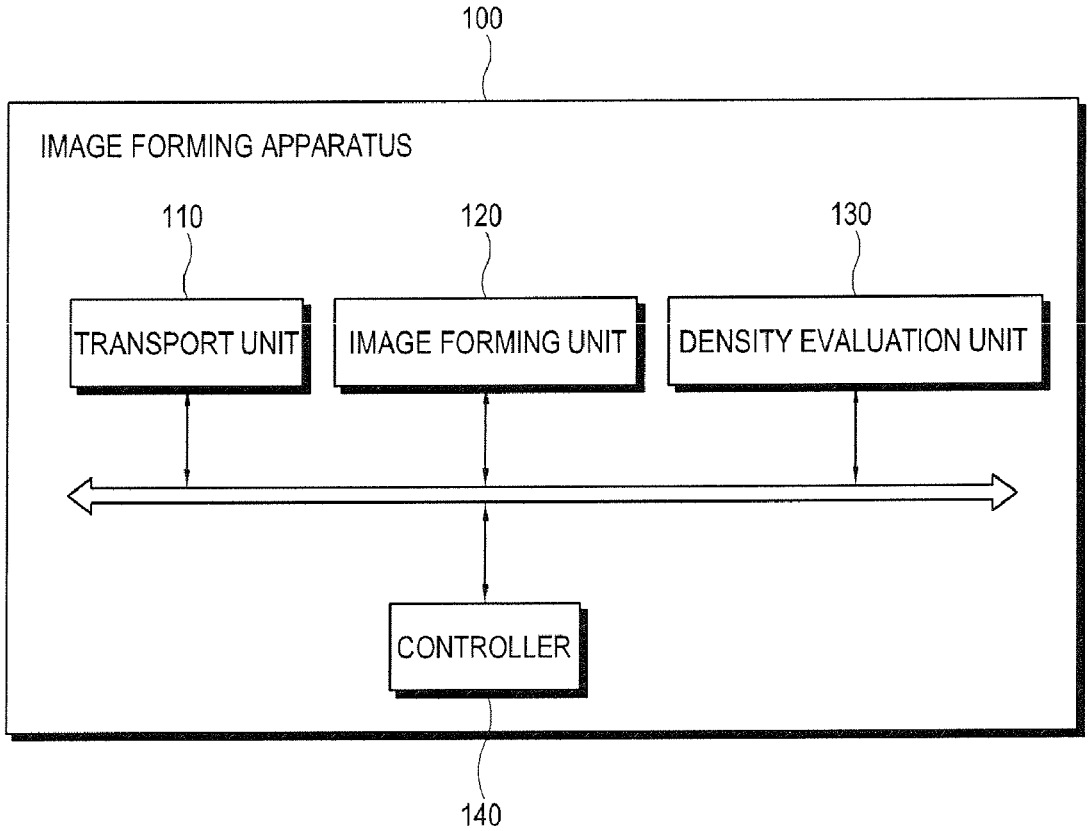
FIG. 2 is a block diagram illustrating an image forming apparatus according to an embodiment of the present invention.

FIG. 2 is a block diagram illustrating an image forming apparatus 100 according to an embodiment of the present invention. The image forming apparatus 100 may be embodied in a variety of ways, such as, for example, a laser printer, a copier, a multi-function device, etc.

As illustrated in FIG. 2, the image forming apparatus 100 includes a transport unit 110, an image forming unit 120, a density evaluation unit 130 and a controller 140. Further, it is understood that the image forming apparatus 100 may have a wide variety of other components in addition to those shown in FIG. 2 and described below, such as feeding cassettes, discharge trays, gears, motors, user interface units, reverse paths, etc.

Figure 3:
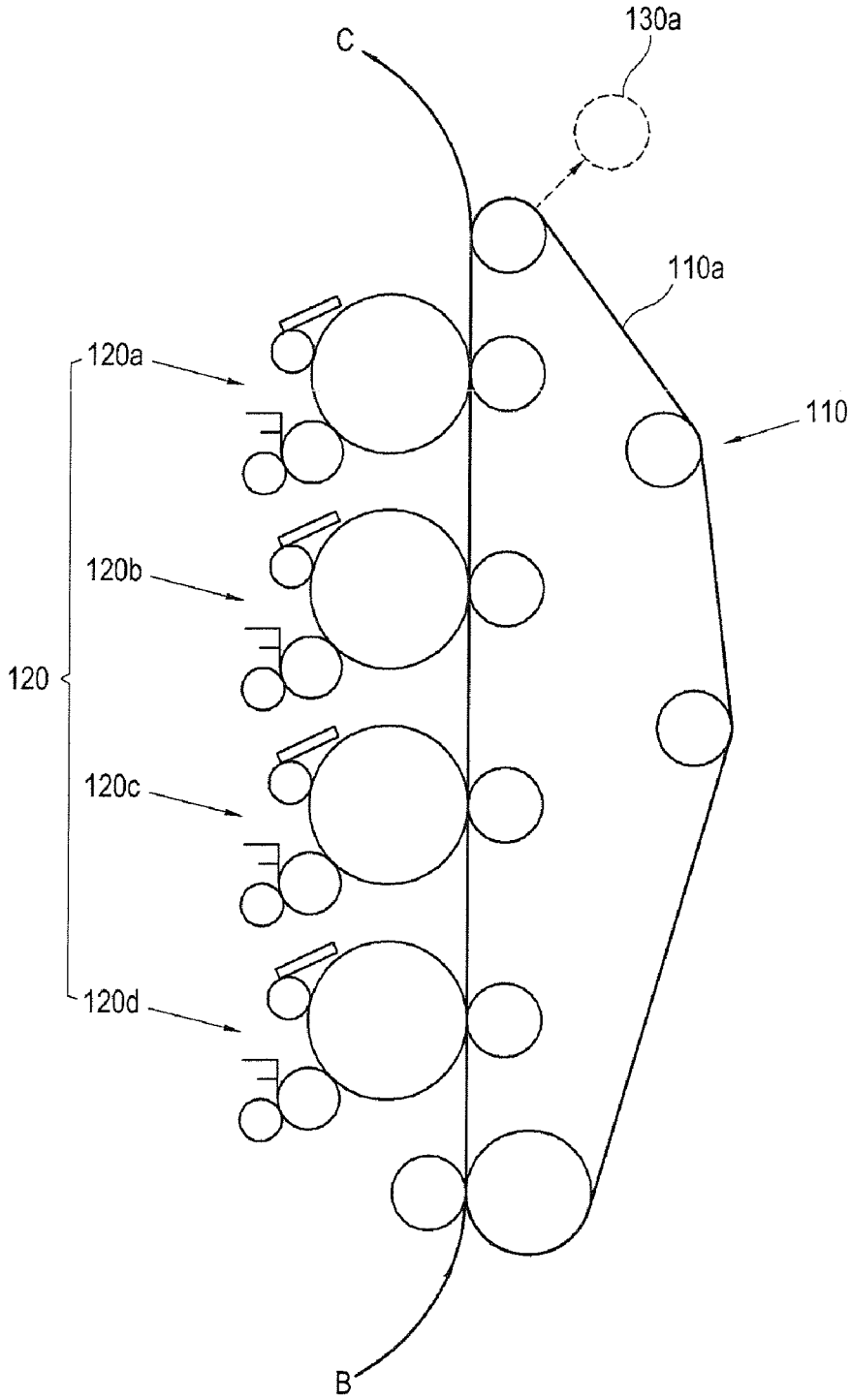
FIG. 3 is a cross-sectional view illustrating a transport unit according to an embodiment of the present invention.

The transport unit 110 transports a printing medium, such as a sheet of paper, a transparent sheet, a piece of stationary, a sheet of recycled paper, etc., under the control of the controller 140. FIG. 3 is a cross-sectional view illustrating the transport unit 110 according to an embodiment of the present invention. The transport unit 110 includes a transport belt **110*a* to transport the printing medium by moving the transport belt 110*a* with the printing medium on a surface thereof. As illustrated in FIG. 3, the printing medium advances along a direction indicated by the arrow "B" and then advances along a direction indicated by the arrow "C" (hereinafter, the directions collectively referred to as a "transport path of a printing medium") by the transport belt 110*a*. That is, the transport belt 110*a*** moves in correspondence to the transport path of the printing medium.

The image forming unit 120 transfers toner according to data to be printed to thereby form an image on the printing medium. As illustrated in FIG. 3, the image forming unit 120 according to an aspect of the present invention includes four sub-image forming units **120*a* through 120*d* in correspondence to each color of C (Cyan), M (Magenta), Y (Yellow) and K (Black). Each of the four sub-image forming units 120*a* through 120*d* performs exposure, development and transfer operations according to printing data. It is understood that the image forming unit 120** is not limited to a CMYK design in all aspects, and may instead include a different number and/or collection of colors of the sub-image forming units, such as, for example, R (Red), Green (G) and Blue (B) sub-image forming units.

Also, the image forming unit 120 forms a test image to control an image forming characteristic under the control of the controller 140. The image forming characteristic is controlled based on a determination of at least one of a condition of development, color registration, etc.

Figure 4:
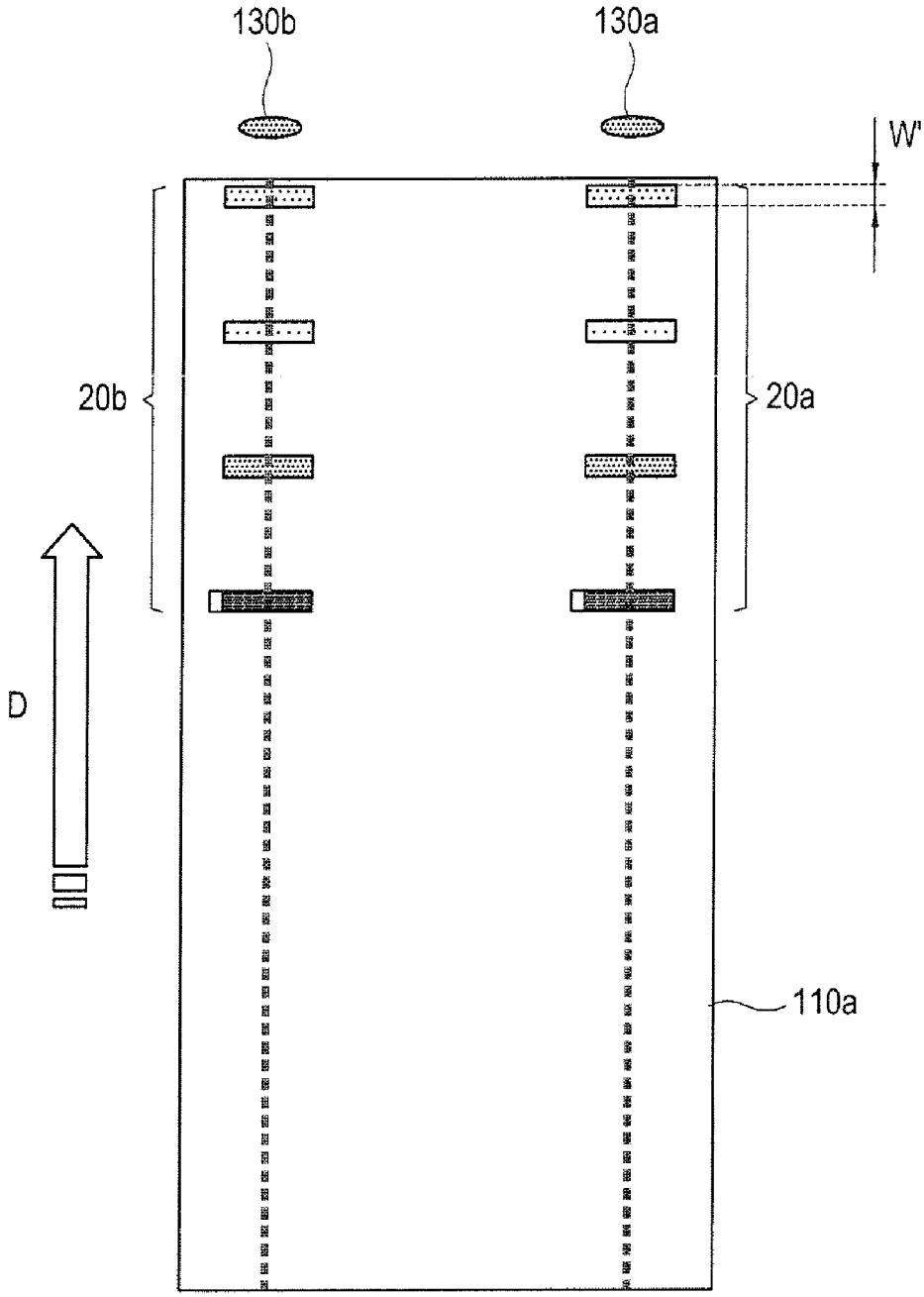
FIG. 4 is a view illustrating a test image formed by the image forming apparatus illustrated in FIG. 2.

FIG. 4 is a view illustrating a test image formed according to an embodiment of the present invention. As illustrated in FIG. 4, the test image according to this embodiment can be formed as a first group 20*a* of density marks. A reference character "D" of FIG. 4 indicates a transport direction of the transport belt 110*a*. The first group 20*a* of density marks is formed at a predetermined position on the surface of the transport belt 110*a*. The first group 20*a* of density marks includes four marks respectively corresponding to the four sub-image forming units 120*a* through 120*d*. However, it is understood that other aspects of the present invention are not limited to forming a group of four density marks, and may instead form any number of density marks, regardless of whether the number of density marks corresponds to the number of sub-image forming units. It is further understood that the density marks are not limited to being rectangular, and may instead take various other shapes, such as circles, triangles, symbols, words, etc.

The density evaluation unit 130 evaluates a density of the test image formed on the transport belt 110*a*. As illustrated in FIGS. 3 and 4, the density evaluation unit 130 includes a first detector 130*a*, such as a photodetector, which is provided on the transport path of the transport belt 110*a*. According to an aspect of the present invention, the first detector 130*a* detects light reflected from the first group 20*a* of density marks.

The first detector 130*a* performs a detection operation at a predetermined drive voltage under the control of the controller 140. The density evaluation unit 130 evaluates the density of the first group 20*a* of density marks according to a detection result obtained by the first detector 130*a* and transmits the evaluation result to the controller 140.

The density evaluation unit 130 may further include a second detector 130*b* in order to improve reliability of the detection result and the evaluation result. As shown in FIGS. 3 and 4, the second detector 130*b* may be arranged in parallel with the first detector 130*a* across the transport direction "D" of the transport belt 110*a*. In this case, as illustrated in FIG. 4, the controller 140 controls the image forming unit 120 so that the second group 20*b* of density marks is formed in correspondence to the second detector 130*b*. Further, it is understood that more than two detectors may be used according to other aspects of the present invention, and that the detectors are not limited to being arranged in parallel with each other as shown in FIG. 4.

The controller 140 performs general control operations of the image forming apparatus 100, such as printing operations, discharging operations, etc. The controller 140 controls the transport unit 110 and the image forming unit 120 so that an image can be formed on a printing medium according to data to be printed.

In addition, the controller 140 controls the transport unit 110 and the image forming unit 120 so that a test image can be formed on the transport belt 110*a* to control an image forming characteristic of the image forming unit 120. The controller 140 controls the transport unit 110 and the image forming unit 120 so that the first group 20*a* of density marks and/or the second group 20*b* of density marks can be formed on the transport belt 110*a* while keeping the transport belt 110*a* moving like an actual printing operation, even though a printing medium is not being transported by the transport belt 110*a*.

The controller 140 according to aspects of the present invention controls the image forming unit 120 so that the length W' of each of the density marks in the first group 20*a* and/or the second group 20*b* in the transport direction "D," i.e., a vertical direction in FIG. 4, can be determined by a position deflection of the transport belt 110*a*. For example, the length of one of the density marks W' in the transport direction is determined to be as small as possible. In other words, the length of the density mark W' in the transport direction has the minimum length at which the density evaluation unit 130 can properly evaluate the density of the density mark. Specifically, the length W' of a density mark in the first group 20*a* and/or the second group 20*b* in the transport direction "D" is determined by the following equation (2):

$$W'(\text{mm})=[\text{Position deflection of the transport belt } 110a \text{ in the transport direction "}D\text{"}]+[\text{Size of detected light}]+[\text{Margin}] \quad \text{(Equation 2)}$$

In equation (2), the position deflection of the transport belt 110*a* in the transport direction "D" refers to a mechanical characteristic of the image forming apparatus 100 when the transport belt 110*a* moves an edge of the density mark past an edge of the first detector 130*a* and/or second detector 130*b* before the transport belt 110*a* can stop due to a delay between detecting the edge of the density mark and stopping the transport belt 110*a*, which is generated in the transport direction "D" with respect to the first detector 130*a* and/or the second detector 130*b*; the size of the detected light is a cross-sectional width of the light detected by the first detector 130*a* and/or the second detector 130*b* in the transport direction "D"; and the margin is an allowance from a design standpoint. For instance, the position deflection of the transport belt 110*a* in the transport direction "D" may be 3 mm, the margin may be set to be ten percent of the position deflection and the size of the detected light is the size of the light reflected off the first density mark and detected by the first and/or second detector 130*a* and 130*b*, which may be an ignorable value with regard to the position deflection.

Meanwhile, when the first detector 130*a* and/or the second detector 130*b* detect the first density mark in the first group 20*a* and/or the first density mark in the second group 20*b*, the controller 140 controls the transport unit 110 so that the transport belt 110 stops moving. In other words, the first detector 130*a* and/or the second detector 130*b* perform a detection operation of the density of the first density mark in the first group 20*a* and/or the density of the first density mark in the second group 20*b* in the state when the transport belt 110 stops moving.

Figure 5:
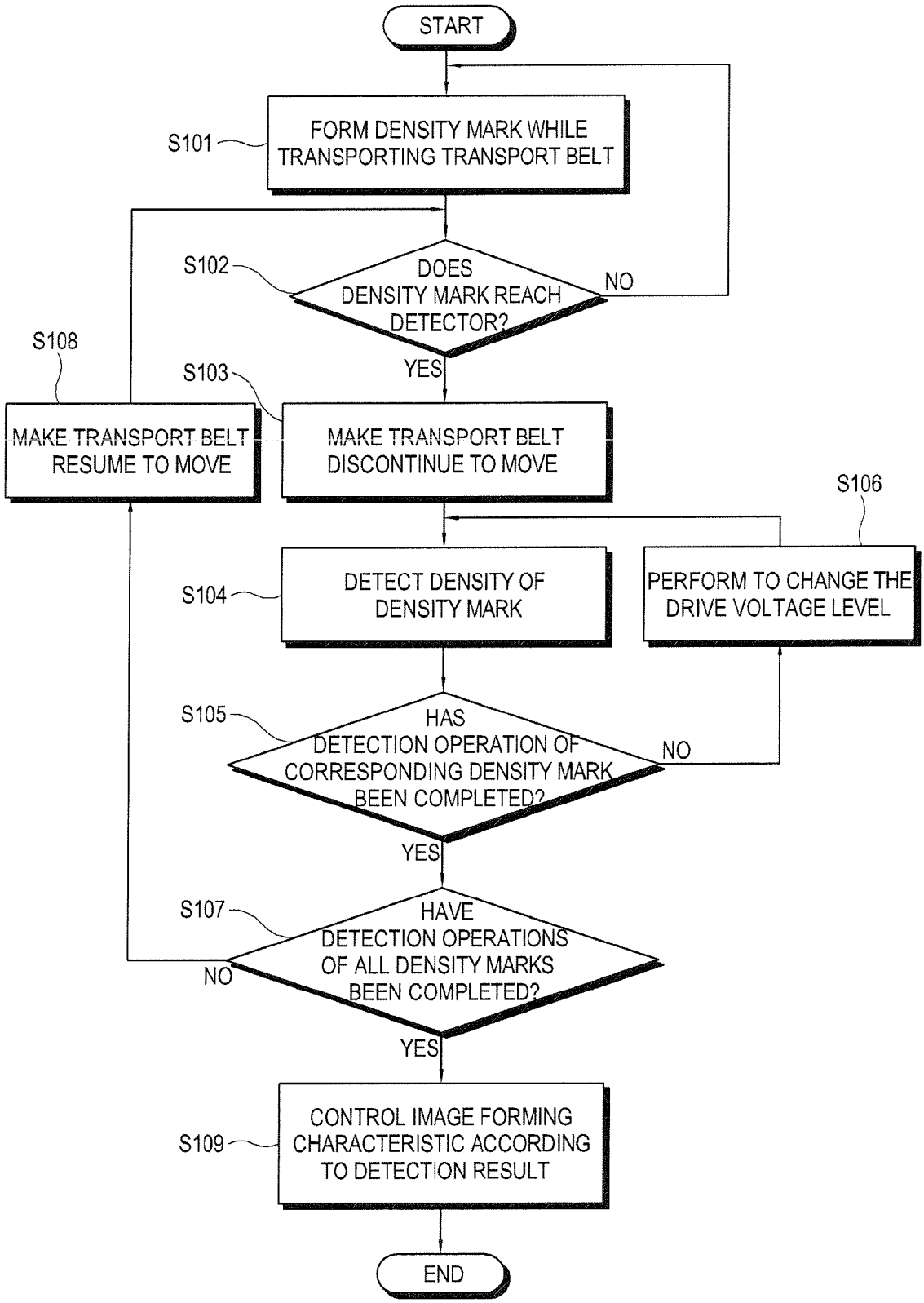
FIG. 5 is a flowchart illustrating a control process of an image forming apparatus according to an embodiment of the present invention.

FIG. 5 is a flowchart illustrating a control process of the image forming apparatus 100 according to an embodiment of the present invention. Hereinafter, the first density mark in the first group 20*a* and the first detector 130*a* will be representatively described, but the first density mark in the second group 20*b* and the second detector 130*b* can be understood to operate in a similar fashion unless otherwise stated. Additionally, as mentioned above, aspects of the present invention are not limited to only using the first and second detectors 130*a* and 130*b*, and are further not limited to using groups of only four density marks.

First, the controller 140 controls the transport unit 110 and the image forming unit 120 so that the first group 20*a* of density marks is formed on the transport belt 110*a* while keeping the transport belt 110 moving normally at operation S101.

Next, the controller 140 determines whether the first density mark of the first group 20*a* has reached the first detector 130*a* at operation S102. If the controller 140 determines that the first density mark of the first group 20*a* has not yet reached the first detector 130*a*, as the result of this confirmation in operation S102, operation S101 continues to proceed.

If, on the other hand, the controller 140 determines that the first density mark of the first group 20*a* has reached the first detector 130*a*, as the result of this confirmation in operation S102, the controller 140 controls the transport unit 110 so that the transport belt 110*a* stops moving at operation S103).

Next, the controller 140 controls the first detector 130*a* to perform a detection operation of the first density mark of the first group 20*a* at operation S104. Then, the controller 140 determines whether the detection operation of the corresponding density mark has been completed at operation S105.

If the confirmation result determined at operation S105 indicates that the detection operation has not yet been completed, the controller 140 changes a drive voltage of the first detector 130*a* by a predetermined value at operation S106. Then, the controller 140 controls the first detector 130 to resume the detection operation at operation S104.

If the confirmation result of operation S105 indicates that the detection operation of the first detector 130*a* to detect the first density mark in the first group 20*a* has been completed, the controller 140 controls the second detector 130*b* to perform a detection operation for the first density mark of the second group 20*b* by repeating operation S104. It is understood that this operation may be omitted if the second group 20*b* of density marks is not used.

Then, if the controller determines at operation S105 that the detection operations of the first detector 130*a* and the second detector 130*b* for the corresponding first density marks of the first group 20*a* and the second group 20*b* have been completed, the controller 140 determines whether the detection operations for all the density marks have been completed at operation S107.

If the controller 140 determines that the detection operations for all the density marks have not yet been completed at operation S107, the controller 140 resumes moving the transport belt 110*a* at operation S108. Then, the controller 140 determines whether a density mark of the next color of the first group 20*a* has reached the first detector 130*a* (S102). The operations of S101 through S108 are then performed again.

Meanwhile, if the controller 140 determines at operation S107 that the detection operations for all the density marks have been completed, the controller 140 controls an image formation characteristic of the image forming unit 120 based on a density evaluated by the density evaluation unit 130 according to the detection result at operation S109. If the control of the image forming characteristic has been completed at operation S109, all operations are completed.

As described above, since the first detector 130*a* performs the detection operation of the first density mark 20*a* in the state that the transport belt 110*a* has discontinued movement, a length W' of one of the density marks in the transport direction "D" of the transport belt 110*a* may be formed into a minimum size at which the first detector 130*a* can reliably perform a detection operation. Therefore, an amount of toner consumed to perform a detection operation of the density marks is minimized.

As described above, aspects of the present invention provide an image forming apparatus which minimizes a consumption of toner to control an image forming characteristic using a test image and a control method thereof.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An image forming apparatus comprising:

a transport unit comprising a transport belt which transports a printing medium along a transport path;

an image forming unit which transfers toner to the printing medium to form an image;

a density evaluation unit which evaluates a density of the image formed by the image forming unit; and a controller which controls the image forming unit to form a test image corresponding to at least one color of toner on the transport belt and controls the transport belt to move at a first speed to detect the formed test image, move at a second speed if the formed test image has reached the density evaluation unit and move at the first speed after the detection of the formed test image is completed.

2. The image forming apparatus according to claim 1, wherein the controller controls the transport belt to move when the density evaluation unit is not evaluating the density of the test image and to stop when the density evaluation unit is evaluating the density of the test image.

3. The image forming apparatus according to claim 2, wherein the controller controls the image forming unit to form the test image so that the test image has a minimum size at which the density evaluation unit can properly evaluate the density of the test image.

4. The image forming apparatus according to claim 3, wherein the controller determines the minimum size by taking into account a position deflection of the test image which occurs when an edge of the test image passes an edge of the density evaluation unit before the controller controls the transport belt to stop.

5. The image forming apparatus according to claim 1, wherein the controller uses a result of the evaluation of the density of the test image to determine an image forming characteristic.

6. The image forming apparatus according to claim 1, wherein the test image is formed on the transport belt.

7. The image forming apparatus of claim 1, wherein the density evaluation unit is provided on the transport path of the transport belt, and the controller controls the image forming unit to form the test image which has a length in a transport direction that is determined by a position deflection of the transport belt when an edge of the test image passes an edge of the density evaluation unit, controls a characteristic of the image forming unit based on a density evaluation of the test image, and controls the transport unit to make the speed of the transport belt a predetermined value or less during the density evaluation of the test image by the density evaluation unit.

8. The image forming apparatus according to claim 7, wherein the length of the test image in the transport direction is determined by the following equation:

the length of the test image in the transport direction =the position deflection of the transport belt in the transport direction +a size of detected light reflected from the test image +a margin.

9. The image forming apparatus according to claim 1, wherein the image forming unit comprises a plurality of sub-image forming units which are provided in correspondence to a plurality of colors and arranged along a transport direction of the printing medium, and the controller controls the density evaluation unit to sequentially evaluate densities of a plurality of the test images corresponding to the plurality of sub-image forming units.

10. The image forming apparatus according to claim 1, wherein the density evaluation unit comprises at least one detector which detects light reflected from the test image.

11. The image forming apparatus according to claim 10, wherein the density evaluation unit performs the density evaluation of the test image while changing a drive voltage level of the detector.

12. The image forming apparatus according to claim 7, wherein the characteristic of the image forming unit is controlled by determining at least one of a condition of development and a color registration.

13. The image forming apparatus of claim 1, wherein the second speed is less than the first speed.

14. The image forming apparatus of claim 1, wherein the speed change of the transporting belt is repeated until all of the formed test images is detected.

15. A method of controlling an image forming apparatus comprising a transport unit having a transport belt which transports a printing medium along a transport path, an image forming unit which transfers toner to the printing medium to form an image, and a density evaluation unit which evaluates a density of the image formed by the image forming units, the control method comprising:

forming a test image corresponding to at least one color of toner on the transport belt;

moving the transport belt at a first speed to detect the formed test image;

determining whether the formed test image reaches the density evaluation unit or not;

moving the transport belt at a second speed if the formed test image has reached the density evaluation unit; and moving the transport belt at the first speed after the detection of the formed test image is completed.

16. The method of claim 15, wherein the moving of the transport belt comprises controlling the transport belt to move when the density evaluation unit is not evaluating the density of the test image and to stop when the density evaluation unit is evaluating the density of the test image.

17. The method of claim 16, wherein the forming of the test image comprises controlling the image forming unit to form the test image so that the test image has a minimum size at which the density evaluation unit can properly evaluate the density of the test image.

18. The method of claim 17, wherein the forming of the test image further comprises taking into account a position deflection of the test image which occurs when an edge of the test image passes an edge of the density evaluation unit before the controller controls the transport belt to stop.

19. The method of claim 15, further comprising using a result of the evaluation of the density of the test image to determine an image forming characteristic.

20. The method of claim 15, wherein the forming of the test image comprises forming the test image on the transport belt.

21. The method of claim 15, wherein the forming of the test image comprises forming the test image which has a length in a transport direction that is determined by a position deflection of the transport belt when an edge of the test image passes an edge of the density evaluation unit, and wherein the method of claim 15 further comprises controlling the transport unit by making a transport speed of the transport belt a predetermined value or less during the density evaluation of the test image by the density evaluation unit, and controlling a characteristic of the image forming unit based on the density evaluation of the test image.

22. The method of claim 21, wherein the forming of the test image which has the length in the transport direction is determined by the following equation:

the length of the test image in the transport direction =the position deflection of the transport belt in the transport direction +the size of detected light reflected by the test image +a margin.

23. The method of claim 15, wherein the image forming unit comprises a plurality of sub-image forming units which are provided in correspondence to a plurality of colors and arranged along a transport direction of the printing medium, and wherein the transport unit is controlled so that the density evaluation unit sequentially evaluates densities of a plurality of the test images corresponding to the plurality of sub-image forming units.

24. The method of claim 15, wherein the density evaluation unit is controlled to perform the density evaluation comprises using at least one detector which detects light reflected from the test image.

25. The method of claim 24, wherein the controlling of the density evaluation unit to perform the density evaluation comprises evaluating the density of the test image while changing a drive voltage level of the detector.

26. The method of claim 21, wherein the controlling of the characteristic of the image forming unit is performed by determining at least one of a condition of development and a color registration.

27. The method of claim 15, wherein the second speed is less than the first speed.

28. The method of claim 15, wherein the speed change of the transporting belt is repeated until all of the formed test images is detected.

* * * * *